United States Patent [19]

Clarke et al.

[11] 4,102,451

[45] Jul. 25, 1978

[54] MIXING VIAL

[75] Inventors: John W. Clarke, Indianapolis; Galer J. Miller, Greenwood, both of Ind.

[73] Assignee: Eli Lilly and Company, Indianapolis, Ind.

[21] Appl. No.: 800,366

[22] Filed: May 25, 1977

[51] Int. Cl.[2] ..... B65D 25/08

[52] U.S. Cl. ..... 206/219; 215/223; 215/DIG. 8

[58] Field of Search ..... 128/272; 206/219, 221, 206/105; 215/6, 223, DIG. 8; 259/DIG. 20

[56] References Cited

U.S. PATENT DOCUMENTS

| | | | |
|---|---|---|---|
| 2,793,776 | 5/1957 | Lipari | 215/DIG. 8 |
| 3,219,220 | 11/1965 | Hakim | 215/223 X |
| 3,464,414 | 9/1969 | Sponnoble | 206/219 X |
| 3,477,431 | 11/1969 | Walecka | 206/221 X |
| 3,860,133 | 1/1975 | Boxer et al. | 215/223 X |
| 3,905,366 | 9/1975 | Callahan et al. | 128/272 X |

FOREIGN PATENT DOCUMENTS

| | | | |
|---|---|---|---|
| 2,268,714 | 11/1975 | France | 206/219 |
| 609,328 | 9/1960 | Italy | 206/219 |

*Primary Examiner*—Steven E. Lipman

*Attorney, Agent, or Firm*—Houston L. Swenson; Arthur R. Whale

[57] ABSTRACT

A dual compartment mixing vial having a center seal isolating one compartment from the other is provided with a stopper at its open end which embodies a rod that is slidably positioned therethrough. The rod, upon being pushed downwardly, abuts the center seal of the vial and causes it to be displaced, thereby permitting the contents of the two compartments to intermix within the closed vial. An activating cap is provided for preventing accidental movement of the rod and to facilitate intentional movement of it.

10 Claims, 10 Drawing Figures

MIXING VIAL

BACKGROUND OF THE INVENTION

In the pharmaceutical field there are numerous medications which are administered in a liquid form. In many instances, these are administered by syringe. Although some types of medications may be packaged and stored in their liquid form there are certain medications which cannot be handled in this fashion due to stability problems. Thus, mixing vials have been provided for containing a dry component such as a powder in one compartment of a vial and a diluent in the other compartment. The two compartments are isolated from each other by a resilient rubber center seal. U.S. Pat. No. 2,908,274, Bujan, illustrates a conventional two-compartment mixing vial.

Mixing vials of this type may be stored for a fairly long period of time without encountering stability problems. When the contents of the vial are to be administered, the powder and diluent are mixed together within the vial and a syringe may be used to withdraw the newly constituted liquid. In the prior art the displacement of the center seal which isolates the two compartments from each other is effected by downwardly pushing a rubber plunger that seals the open end of the vial. This plunger, when pushed downwardly, acts as a piston and transmits force through the diluent in the upper compartment of the vial. The hydraulic pressure resulting from this action causes the center seal to become dislodged and fall into the bottom compartment of the vial. The liquid and powder then become intermixed and can be withdrawn by inserting a hollow needle through the plunger which is still positioned at the open end of the vial.

In such vials of the prior art, it is essential that the downward movement of the plunger which serves as a piston is somewhat restrained. U.S. Patent No. 3,087,638, Loper, teaches the use of a metallic ring which is positioned over the neck of the vial with upwardly extending pointed teeth for engaging the plunger thereby preventing the plunger from passing through the opening of the vial and into the medication. It is also apparent that in order to dislodge the center seal with the hydraulic pressure created by the downward movement of the plunger that the upper compartment must contain liquid. From a production standpoint, there are certain instances where it would be preferable to place the liquid in the lower compartment of the vial and then place powder in the upper compartment, an arrangement which would not provide full assurance of being able to displace the center seal.

In order to avoid these limitations that accompany the use of hydraulic pressure for displacing the center seal, various ideas have been developed with respect to mechanically displacing the center seal. U.S. Pat. No. 3,842,836, Ogle, has suggested the use of a probe or pointed rod that can be inserted through the plunger of the vial to reach and dislodge the center seal. While such a procedure would effectively dislodge the center seal, it creates additional production problems in that the probe that would accompany the vial would require a separate sterile package. Furthermore, the integrity of the sealed vial would be broken by the introduction of the "foreign" probe.

U.S. Pat. No. 2,689,566, Lockhart, discloses a plural compartment vial with a center seal which is dislodged by a hollow dropper rod. The rod and a flexible bulb enveloping its exterior end are removable for administering drops of the mixture. The bulb is subject to accidental actuation and also comes into direct contact with the fingers of the operator. Although such physical contact is not objectionable for administering drops there is a reluctance for this to occur if a sterile syringe needle is to pierce the bulb for removal of the medication.

SUMMARY OF THE INVENTION

Our invention utilizes a conventionally designed two-compartment mixing vial and center seal. The stopper for our vial may be formed of a resilient rubber-like material and has a friction fit with the inside wall of the open neck of the vial. A plastic or metal seal may also be used to retain the stopper in the vial. A relatively rigid rod is slidably mounted through the stopper and extends downwardly into the first compartment of the vial in close proximity with the center seal. The rod is enveloped by an integrally molded portion of the stopper at its exterior end in order to avoid any contamination of the rod. The extending portion of the stopper is of a compressible design.

A two-piece plastic cap is removably seated over the vial's neck and the stopper, including its extension. The cap has a downwardly movable center portion which is normally kept in a locked position to avoid accidental movement. In order to dislodge the vial's center seal, the cap's center portion is rotated to an unlocked position and pushed downwardly to move the stopper extension and rod downwardly. This causes the rod's interior end to displace the center seal. Removal of the medication after being mixed may be accomplished by removing the two-piece cap and inserting a conventional needle through the stopper.

DESCRIPTION OF THE PREFERRED EMBODIMENTS

Figure 2:
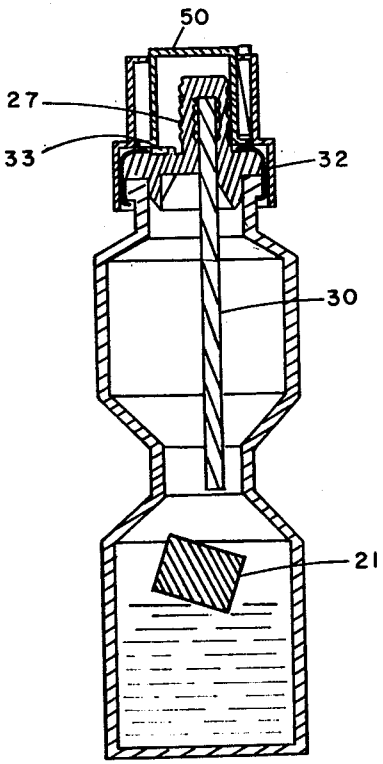
FIGS. 1 and 2 are views taken in cross section along the longitudinal line of a mixing vial of this invention showing its positions prior to mixing and subsequent to mixing, respectively.

The preferred embodiment of our invention as illustrated in FIGS. 1 through 10 utilizes a conventional mixing vial 11 having an upper compartment 13 and a lower compartment 14 connected together by a cylindrical portion 16. The lower compartment 14 has a closed end 17 whereas the upper compartment 13 has an open end 18. Both compartments as well as the cylindrical portion 16 and neck 20 defining the vial's open end are of circular cross-section and are coaxial with each other. A center seal 21 may be inserted with a friction fitment in the cylindrical portion 16 to isolate the two compartments from each other. This center seal is of cylindrical configuration and may be similar to the silicon coated butyl rubber plug described in U.S. Pat. No. 3,464,414, Sponnoble.

Figure 1:
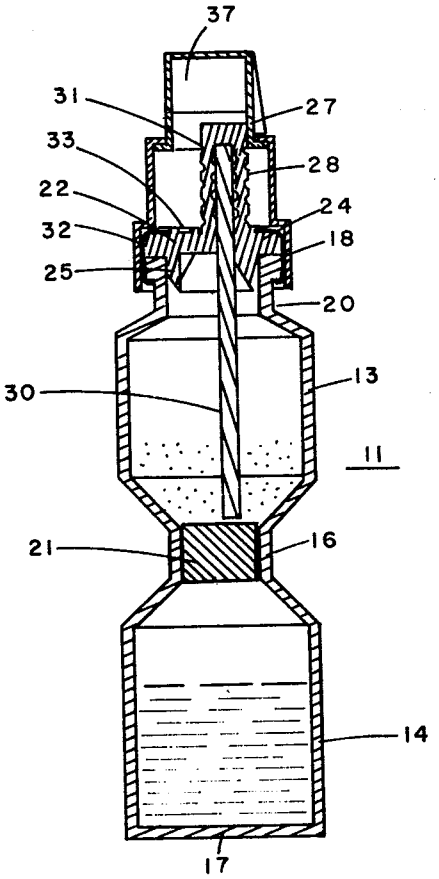

The vial stopper 22 may also be formed of a butyl rubber or other elastomeric composition which provides sufficient resiliency without losing its molded configuration when it is compressed into the vial neck 20. Stopper 22 has a head surface 24 which abuts the exterior top of the vial's neck. Depending from the inner surface of this head portion is an annular wall 25 serving as the stopper's plug. This annular wall is of a diameter slightly larger than the inside diameter of the vial's neck and is slightly compressed when it is forced into the vial. Projecting from the outer head surface 24 of the stopper is a longitudinally compressible sleeve 27 that is integrally molded with the stopper. Sleeve 27 is hollow and is provided with internal and external corrugated ribbing 28 to aid in its compressibility. A solid and rigid rod 30 made of glass, metal or an inert plastic material is inserted into the hollow portion of sleeve 27. Rod 30 may be coated with silicon at its top end to facilitate assembly in sleeve 27 and also to permit limited relative sliding therein when the sleeve is compressed. This rod is dimensioned in accordance with the overall dimensions of the vial in such a manner that, as illustrated in FIG. 1, its internal end is in close proximity with inner seal 16. A conventional annular metal seal 32 may be crimped over stopper 22 and the vial's neck 20 to assist in maintaining the stopper in its sealed position.

In order to utilize this vial, one need merely compress downwardly on the compressible sleeve 27 which forces rod 30 to displace the center seal as shown in FIG. 2. The vial may then be shaken several times to fully mix the powder and diluent. To withdraw this medication, a needle may be inserted through the stopper at the target zone marking 33. It is to be noted that in order to place the target zone for insertion of the needle within the confines of the stopper's wall that sleeve 27 is placed slightly off center. Prior to entry of the needle, the integrity of the vial has been maintained since no outside device has been used to dislodge center seal 16.

Vial cap 35, as shown in FIGS. 3 through 10, comprises an upper plastic portion, plunger 37, and a lower plastic portion, base 38. Base 38 (FIGS. 6 and 7) is of hollow cylindrical configuration and has a lower section 40 which removably snaps over the vial's neck and metal seal 32. The upper portion 41 of base 38 has an inwardly extending ledge 43. Equally spaced on the exterior surface of ledge 43 are three sets each of a rectangular cutout 45, projection stop 46 and a locking nib 47. Base ledge 43 is relatively thin in order to permit temporary flexing.

Figure 3:
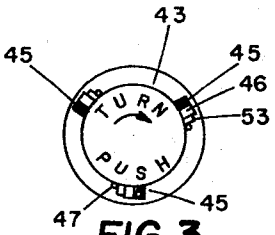
FIG. 3 is a top view of the vial's two-piece cap.
Figure 4:
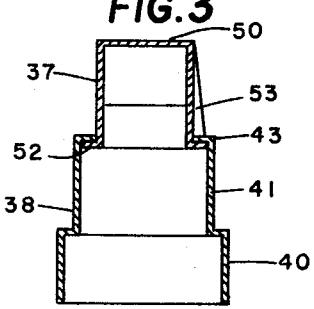
FIGS. 4 and 5 are views in cross section of the vial prior to and after actuating the vial, respectively.
Figure 5:
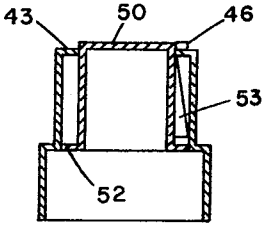
Figure 6:
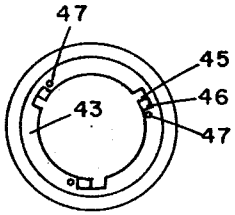
FIGS. 6 and 7 are the top and side views of the two-piece cap's lower portion, respectively.
Figure 7:
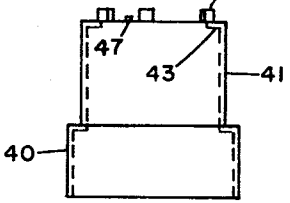
Figure 8:
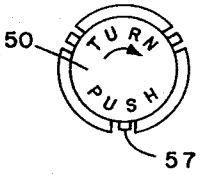
FIGS. 8, 9 and 10 are the top, side and bottom views of the two-piece cap's upper portion.
Figure 9:
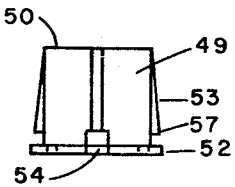
Figure 10:
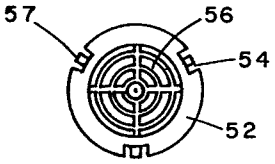

The upper plastic portion plunger 37, (FIGS. 8–10) has a cylindrical side wall 49 and a top wall 50. Wall 49 is dimensioned to snugly move in the opening defined by ledge 43 on base 38. A retaining flange 52 prevents the plunger from separating from the base by seating against the inner surface of ledge 43 (FIG. 3). Three upwardly tapered ribs 53 are spaced about side wall 49. The cutouts 54 on flange 52 are formed only as a result of the molding technique used to form the ribs. Referring to FIG. 10, a reinforcing surface having a plurality of rings 56 is formed on the inner surface of top wall 50. The rings provide rigidity for the top wall and also assist in the frictional engagement with the top of sleeve 27.

To assemble the two-piece cap, plunger 37 is inserted into the interior of base 38 and forced through the opening defined by ledge 42. There is no need to align ribs 53 with the base cutouts 45. Ribs 53 are tapered to permit them to be forced past the ledge which will flex temporarily until the ribs have cleared the ledge. It is to be noted that each rib at its larger end 57 is spaced from the plunger's flange. Consequently, after the ribs have cleared ledge 43 the plunger remains connected to the base due to the entrapment of base ledge 43 between rib ends 57 and plunger flange 52. This space is dimensioned to permit easy rotation of the plunger. Plunger 37 is then rotated counter-clockwise to cause the ribs to override locking nibs 47 and abut against the projection stops 46.

When one is ready to mix the powder and diluent in the vial, he first rotates the plunger clockwise forcing the ribs over the locking nibs 47. Ribs 53 come to rest against stops 46 and are automatically aligned with cutouts 45. Plunger 37 is pushed downwardly and, upon contacting the top of compressible sleeve 27, forces rod 30 to displace the center seal as shown in FIG. 2. Reinforcing rings 56 assist in effecting a vertical movement of the sleeve and rod, which otherwise might tend to tilt under pressure. The frictional surface of these reinforcing rings provides better frictional engagement with the rod and sleeve, thereby maintaining the rod in a preferred vertical attitude. The vial may then be shaken several times to fully mix the powder and diluent. To withdraw the medication, cap 35 is removed and a syringe needle is inserted through the target zone 33 of the stopper.

What is claimed is:

1. In a mixing vial having an upper compartment with an open end, a lower compartment with a closed end and a restricted cylindrical portion therebetween having a cylindrical seal plung isolating said compartments from each other, the improvement comprising a stopper sealing said vial's open end, said stopper having an intergrally formed compressible hollow sleeve, a rigid rod slidably positioned through said stopper with an inner end secured within said sleeve, and a cap removably mounted over said stopper, said cap having a cylindrical lower base portion with an opening defined by an inwardly extending flexible ledge, and a cylindrical upper plunger portion having a top wall slidably extending through said opening and maintained in an upper position by a plurality of ribs on said plunger portion which rest on said base ledge, said ledge having a plurality of cutouts dimensioned to permit passage of said ribs therethrough to bring said plunger in contact with said sleeve containing said rod.

2. The improvement of claim 1 in which said plunger has a cylingrical side wall with a flange extending from an open end and seated underneath said base's ledge.

3. The improvement of claim 2 in which said ribs are upwardly tapered, with each of said ribs having a larger end spaced from said plunger flange.

4. The improvement of claim 3 in which said base ledge is snugly positioned in the space defined by said plunger ribs and flange.

5. The improvement of claim 3 in which each cutout in said ledge has an adjacent projection stop and a locking nib spaced from said stop to receive the larger end of a tapered rib.

6. The improvement of claim 5 in which said locking nib is dimensioned to permit overriding by said rib's larger end upon forceful rotation of said plunger.

7. The improvement of claim 6 in which rotation of said plunger is limited by said projection stops against said ribs to align said ribs with said cutouts.

8. The improvement of claim 7 in which said plunger's top wall has a pluarlity of spaced concentric rings formed on its inner surface for positive contact with said sleeve.

9. The improvement of claim 1 in which said rod and vial are non-coaxial and a target zone is shown in said stopper for insertion of a needle.

10. The improvement of claim 9 in which said rod has a silicone film on its upper end contained within said stopper sleeve.

* * * * *